US007799140B1

(12) United States Patent
Altavela et al.

(10) Patent No.: US 7,799,140 B1
(45) **Date of Patent: *Sep. 21, 2010**

(54) PROCESS FOR THE REMOVAL OF PHOTORECEPTOR COATINGS USING A STRIPPING SOLUTION

(75) Inventors: Robert P. Altavela, Webster, NY (US); Yuhua Tong, Webster, NY (US); Edward F. Grabowski, Webster, NY (US); Kent J. Evans, Lima, NY (US); Adilson Ramos, Webster, NY (US); Nancy Belknap, Rochester, NY (US); Helen R. Cherniack, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/486,591

(22) Filed: Jun. 17, 2009

(51) Int. Cl.
*C23G 1/02* (2006.01)

(52) U.S. Cl. ..... 134/3; 134/1; 134/2; 134/26; 134/28; 134/30; 134/34; 134/36; 134/41; 134/42; 430/133; 430/134

(58) Field of Classification Search ..... 430/133, 430/134; 134/1, 2, 3, 26, 28, 30, 34, 36, 134/41, 42
See application file for complete search history.

(56) References Cited

U.S. PATENT DOCUMENTS

| | | | | |
|---|---|---|---|---|
| 3,121,006 | A | | 2/1964 | Middleton et al. |
| 4,464,450 | A | | 8/1984 | Teuscher |
| 4,518,669 | A | | 5/1985 | Yashiki |
| 4,579,801 | A | | 4/1986 | Yashiki |
| 4,587,189 | A | | 5/1986 | Hor et al. |
| 4,775,605 | A | | 10/1988 | Seki et al. |
| 5,017,449 | A | | 5/1991 | Yoshihara |
| 5,080,993 | A | * | 1/1992 | Maruta et al. ..... 430/128 |
| 5,153,094 | A | | 10/1992 | Kazmaier et al. |
| 5,166,339 | A | | 11/1992 | Duff et al. |
| 5,189,155 | A | | 2/1993 | Mayo et al. |
| 5,189,156 | A | | 2/1993 | Mayo et al. |
| 5,344,734 | A | | 9/1994 | Monbaliu et al. |
| 5,352,329 | A | * | 10/1994 | Herbert et al. ..... 216/83 |
| 5,378,315 | A | * | 1/1995 | Hendrix et al. ..... 216/92 |
| 5,385,796 | A | | 1/1995 | Spiewak et al. |
| 5,397,666 | A | * | 3/1995 | Fukuda et al. ..... 430/58.1 |
| 5,403,692 | A | * | 4/1995 | Yokokawa et al. ..... 430/135 |
| 5,405,724 | A | * | 4/1995 | Hsieh et al. ..... 430/58.8 |
| 5,449,573 | A | | 9/1995 | Aoki et al. |
| 5,489,496 | A | | 2/1996 | Katayama et al. |
| 5,641,599 | A | | 6/1997 | Markovics et al. |
| 5,656,407 | A | | 8/1997 | Kawahara |

(Continued)

OTHER PUBLICATIONS

Sigma Aldrich catalog, product detail of nitric acid, pp. 1-2, May 21, 2010.*

(Continued)

*Primary Examiner*—Sharidan Carrillo
(74) *Attorney, Agent, or Firm*—Pillsbury Winthrop Shaw Pittman LLP

(57) ABSTRACT

The disclosed embodiments are directed to processes for removing photoreceptor coatings from a substrate, wherein the photoreceptor coatings disposed over a substrate of an electrophotographic photoreceptor. More specifically, the invention discloses a photoreceptor coatings removal process comprises subjecting an electrophotographic photoreceptor to a stripping solution that separates the coatings from the substrate.

18 Claims, 2 Drawing Sheets

U.S. PATENT DOCUMENTS

| | | | |
|---|---|---|---|
| 5,721,080 | A | 2/1998 | Terrell et al. |
| 5,756,245 | A | 5/1998 | Esteghamatian et al. |
| 5,928,824 | A | 7/1999 | Obinata et al. |
| 6,180,309 | B1 | 1/2001 | Maty et al. |
| 6,200,716 | B1 | 3/2001 | Fuller et al. |
| 6,207,334 | B1 | 3/2001 | Dinh et al. |
| 2005/0244731 | A1* | 11/2005 | Miskinis et al. ..... 430/69 |

OTHER PUBLICATIONS

U.S. Appl. No. 12,486,668, filed Jun. 17, 2009, Altavela, et al.

* cited by examiner

PROCESS FOR THE REMOVAL OF PHOTORECEPTOR COATINGS USING A STRIPPING SOLUTION

CROSS REFERENCE TO RELATED APPLICATIONS

Reference is made to co-pending, U.S. patent application to Altavela et al., filed the same day as the present application, entitled, "Photoreceptor with Release Layer" Ser. No. 12/486,668, the entire disclosures of which are incorporated herein by reference in its entirety.

BACKGROUND

This disclosure relates generally to processes for removing photoreceptor coatings from a substrate, wherein the photoreceptor coatings disposed over a substrate of an electrophotographic photoreceptor. More specifically, the invention discloses a photoreceptor coatings removal process comprises subjecting an electrophotographic photoreceptor to a stripping solution that separates the coatings from the substrate.

According to one aspect of the disclosed invention, there is provided methods for recycling or remanufacturing electrophotographic photoreceptors.

In electrophotography, the substrate for photoreceptors in a rigid drum format is required to be manufactured with high dimensional accuracy in terms of straightness and roundness, optimum surface reflectance and roughness, and desired thickness. In order to obtain such a dimensional accuracy, the substrate surface is polished at a high accuracy by using sand blustering, glass bean honing, or a diamond tool and/or the like. Once the substrate surface is formed, at least one coating of photosensitive material is applied to the substrate, which may comprise a charge generation layer and a charge transport layer, or their blended in a single layer, to form a full photoreceptor device.

The fabricated photoreceptor devices are expected to have good electrical and mechanical performance in a copier or printer. But, due to complexity of the manufacturing process, it is unavoidable to have varieties of defects in some photoreceptor devices which may meet the quality requirements for the copier or printer. The defective devices have to be rejected. In another aspect, each photoreceptive device has limited application life. Once the photoreceptor device cannot function well in the machine, it is also the end of the application life of the device. These used photoreceptor devices were usually disposed in the same way as the defective devices were treated. Disposal of the device could be very costly and could cause lots of environmental issues.

Thus, there exists a need to reduce the cost of remanufacturing electrophotographic photoreceptors, for example, by recycling the non-usable photoreceptor devices, through removing the photosensitive or coating layers without damaging the substrate formation. This not only reduces the cost of producing the photoreceptor, but also decreases the cost for disposing all related materials in the devices.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

Conventional undercoat or charge blocking layers are also disclosed in U.S. Pat. No. 4,464,450; U.S. Pat. No. 5,449,573; U.S. Pat. No. 5,385,796; and Obinata et al, U.S. Pat. No. 5,928,824, which are all herein incorporated by reference.

The terms used to describe the imaging members, their layers and respective compositions, may each be used interchangeably with alternative phrases known to those of skill in the art. The terms used herein are intended to cover all such alternative phrases.

SUMMARY

According to aspects illustrated herein, there is provided methods of separating a plurality of coating layers from a substrate of an electrophotographic photoreceptor, wherein the plurality of coating layers are disposed over the substrate, the method comprising subjecting the electrophotographic photoreceptor to a stripping solution, wherein the stripping solution comprises nitric acid, hydrofluoric acid, hydrochloric acid, phosphoric acid, sulfuric acid, oxalic acid, acetic acid, carbonic acid, lactic acid, formic acid, malic acid, phthalic acid, or mixtures thereof; and separating the plurality of coating layers from the substrate.

In one embodiment, the electrophotographic photoreceptor further comprises a flange adhesively fixed to at least one end of the substrate and the method further includes separating the flange from the substrate.

In certain embodiments, the subjecting step comprises soaking the electrophotographic photoreceptor in the stripping solution. In one embodiment, the stripping solution comprises nitric acid. The nitric acid may have a concentration of from about 5% by weight to about 90% by weight, or from about 35% by weight to about 80% by weight. The stripping solution may further comprise an ammonium sulfamate. The ammonium sulfamate may have a concentration of less than 5% by weight. The stripping solution may further comprise an oxidizing agent. The oxidizing agent may have a concentration of less than 20% by weight. The oxidizing agent may be hydrogen peroxide.

In one embodiment, a cathodic current is applied to the substrate during the subjecting step. In another embodiment, the cathodic current is of a density between 10 to 100 ampere per square. In yet another embodiment, the electrophotographic photoreceptor is soaked in the stripping solution for a period of between about 1 minute and about 10 hours. In one embodiment, the stripping solution may be maintained at a temperature in a range of 20° C. to 98° C. In one embodiment, the thickness of the substrate is from about 0.25 to about 5 mm. In one embodiment, the substrate is made from aluminum, an aluminum alloy, nickel, steel, or copper.

In embodiments, the plurality of coating layers comprises one or more of the following layers: an undercoat layer, a charge generation layer, a charge transport layer, an overcoat layer, and a single imaging layer comprising a combination of a charge transport layer and a charge generation layer. The plurality of coating layers may further comprises an adhesive layer disposed over the substrate.

Embodiments herein also provide methods of separating a plurality of coating layers from a substrate of an electrophotographic photoreceptor, wherein the plurality of coating layers are disposed over the substrate, the method comprising soaking the electrophotographic photoreceptor in a stripping solution, wherein the stripping solution comprises nitric acid, hydrofluoric acid, hydrochloric acid, phosphoric acid, sulfuric acid, oxalic acid, acetic acid, carbonic acid, lactic acid, formic acid, malic acid, phthalic acid, or mixtures thereof; degrading the plurality of coating layers with the stripping solution; and separating the plurality of coating layers from the substrate.

Embodiments herein further provide methods of separating a plurality of coating layers from a substrate of an electrophotographic photoreceptor, wherein the plurality of coating layers are disposed over the substrate, the method comprising soaking the electrophotographic photoreceptor in a stripping solution, wherein the stripping solution comprises nitric acid; degrading the plurality of coating layers with the stripping solution; and separating the plurality of coating layers in its entirety from the substrate without degrading or attacking any portion of the substrate.

BRIEF DESCRIPTION OF THE DRAWINGS

For a better understanding, reference may be had to the accompanying figure.

Unless otherwise noted, the same reference numeral in different Figures refers to the same or similar feature.

DETAILED DESCRIPTION

Figure 1:
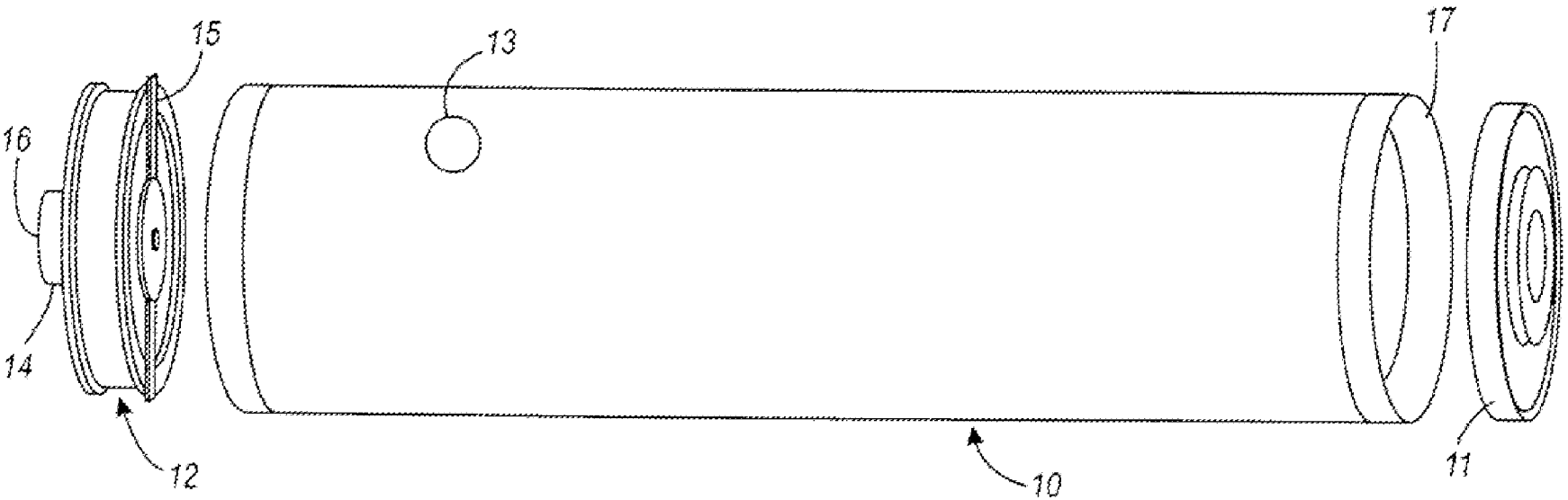
FIG. 1 is an illustration of an electrophotographic photoreceptor in accordance with the present embodiments.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size; or location.

FIG. 1 is an illustration of an electrophotographic photoreceptor showing the construction of the photoreceptor drum and various key layers. As shown in FIG. 1, the electrophotographic photoreceptor includes a cylindrical photoreceptor drum 10, and flanges 11 and 12 fitted to the opening at each end of the photoreceptor drum 10. Outboard flange 11 and Inboard flange 12 are mounted at the ends of the cylindrical counter bore 17 using an epoxy adhesive. Inboard flange 12 consists of a bearing 14, ground strap 15 and drive gear 16. In some designs, either flange could containing the ground strap, the drive gear and the bearing or the function can be split between the two flanges in any combination that has a spring contact to the bearing shaft and a friction contact to the inner substrate surface. The other members 13 constituting the electrophotographic photoreceptor are described below. The member layers 13 are shown in FIG. 2.

Figure 2:
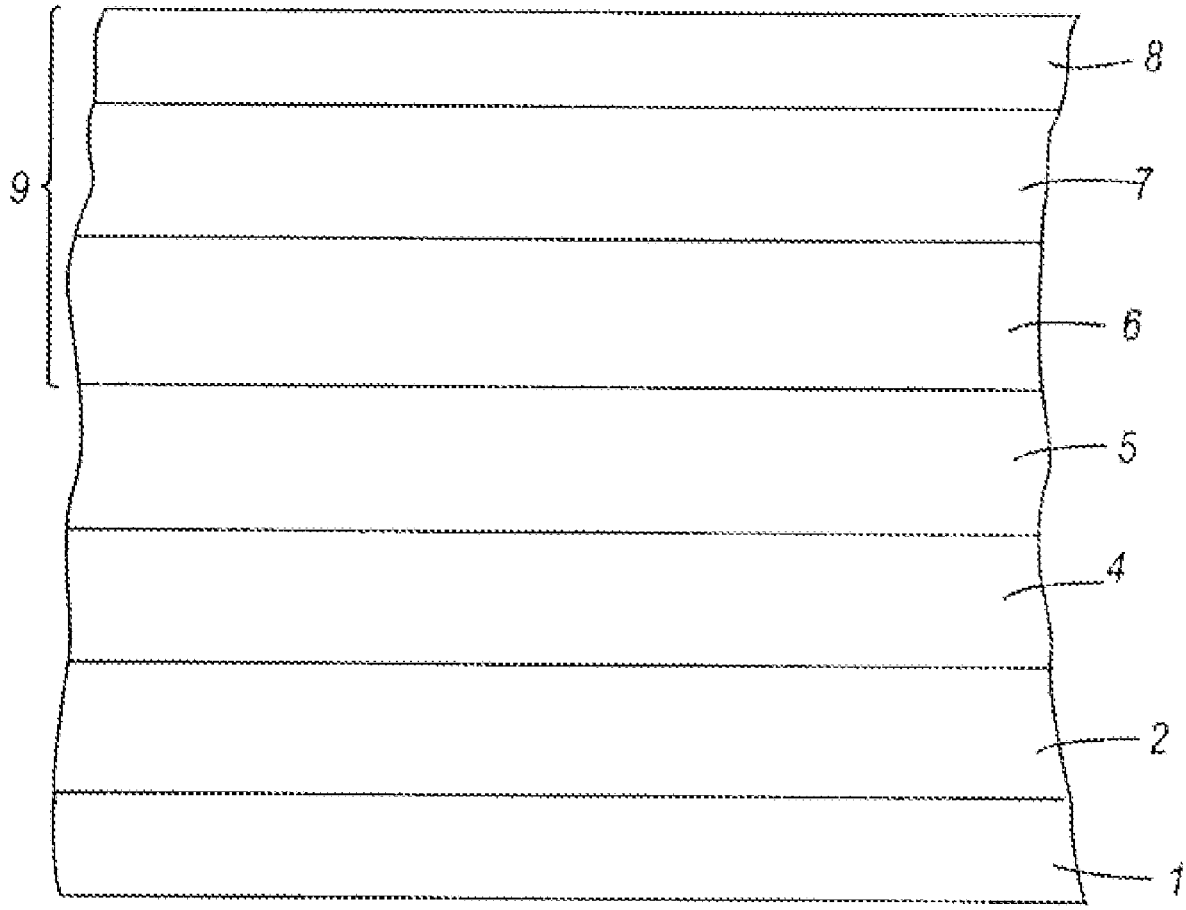
FIG. 2 illustrates an electrophotographic photoreceptor showing various layers in accordance with the present embodiments.

FIG. 2 illustrates a typical electrophotographic photoreceptor showing various layers. Multilayered electrophotographic photoreceptors or imaging members can have at least two layers, and may include a conductive substrate, an undercoat layer, an optional adhesive layer, a photogenerating layer, a charge transport layer, an optional overcoat layer. In the multilayer configuration, the active layers of the photoreceptor are the undercoat layer, the charge generation layer (CGL) and the charge transport layer (CTL). Enhancement of charge transport across these layers provides better photoreceptor performance. Overcoat layers are commonly included to increase mechanical wear and scratch resistance to prolong the life of photoreceptor device.

An electrically conducting substrate may be any metal, for example, aluminum, nickel, steel, copper, and the like or a polymeric material, filled with an electrically conducting substance, such as carbon, metallic powder, and the like, or an organic electrically conducting material. In certain embodiments, the substrate is made from aluminum or an aluminum alloy.

The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or, of a minimum thickness of less than a millimeter. Similarly, a flexible belt may be of substantial thickness, for example, about 250 micrometers, or of minimum thickness less than 50 micrometers, provided there are no adverse effects on the final electrophotographic device. The wall thickness of the drum substrate is manufactured to be at least about 0.25 mm to fulfill the physical requirements of the photoreceptor device. In one embodiment, the thickness of the substrate is from about 0.25 mm to about 5 mm. In one embodiment, the thickness of the substrate is from about 0.5 mm to about 3 mm. In one embodiment, the thickness of the substrate is from about 0.9 mm to about 1.1 mm. However, the thickness of the substrate can also be outside of these ranges.

The surface of the substrate is polished to a mirror-like finish by a suitable process such as diamond turning, metallurgical polishing, glass bead honing and the like, or a combination of diamond turning followed by metallurgical polishing or glass bead honing. Minimizing the reflectivity of the surface may eliminate defects caused by surface reflections that have the appearance of a plywood patterns in half tone areas of prints. Exceeding certain surface roughness, for example, 5 microns, may lead to undesirable and non-uniform electrical properties across the device, which cause poor imaging quality. In certain embodiments, the surface roughness of the substrate is controlled to be less than 1 microns, or less than 0.5 microns.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors.

In some embodiments, an adhesive layer may be applied on the conductive substrate to improve the adhesion of image membrane and substrate in order to achieve desired mechanical property of the device.

An undercoat layer 4 may be applied to the substrate 1, or onto the electrically conductive coating 2, if present. In one embodiment, the thickness of the undercoat layer is from about 0.1 to about 30 microns. In one embodiment, the thickness of the undercoat layer is from about 1 nm to about 20 microns. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

At least one imaging layer 9 is formed on the adhesive layer 5 or the undercoat layer 4. The imaging layer 9 may be a single layer that performs both charge-generating and charge transport functions as is well known in the art, or it may comprise multiple layers such as a charge generator layer 6, a charge transport layer 7, and an optional overcoat layer 8.

The charge generation layer 6 may thereafter be applied to the undercoat layer 4. Any suitable charge generation layer including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the charge generation layer 6, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In one embodiment, the thickness of the charge generation layer 6 is from about 10 nm to 5 microns. In one embodiment, the thickness of the charge generation layer is from about 20 nm to 1 micron.

The charge transport layer 7 may comprise a charge transport material dissolved or molecularly dispersed in a film forming electrically inert polymer such as a polycarbonate. Any suitable charge transporting or electrically active material may be employed in the charge transport layer of this invention. The expression of charge transport materials is defined herein as a molecule that allows the free charge photogenerated in the charge generation layer to be transported across the transport layer to reach on the surface of the photoreceptor membrane. Typical charge transport molecules include, for example, pyrazolines such as 1-phenyl-3-(4'-diethylamino styryl)-5-(4"-diethylamino phenyl)pyrazoline, triarylamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like.

The thickness of the charge transport layer is from about 0.5 microns to about 50 microns. In one embodiment, the thickness of the charge transport layer is from about 15 to about 35 microns.

The embodiments provide methods for separating a plurality of coating layers from a substrate of an electrophotographic photoreceptor. In cases where the electrophotographic photoreceptor comprises a flange that is disposed at an end portion of the photoreceptor drum, the embodiments provide methods for separating a plurality of coating layers and one or more flanges from a substrate of an electrophotographic photoreceptor. The method comprises subjecting the electrophotographic photoreceptor to a stripping solution, and separating the plurality of coating layers and/or flanges from electrophotographic photoreceptor. In certain embodiments, the method comprises soaking the electrophotographic photoreceptor to a stripping solution, and separating the plurality of coating layers from electrophotographic photoreceptor.

Other layers of the imaging member may include, for example, an optional overcoat layer 8. An optional overcoat layer 8, if desired, may be disposed over the charge transport layer 7 to provide imaging member surface protection as well as improve resistance to abrasion. In embodiments, the overcoat layer 8 may have a thickness ranging from about 0.1 micrometer to about 10 micrometers or from about 1 micrometer to about 10 micrometers, or in a specific embodiment, about 3 micrometers. These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, potyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

The stripping solution provided herein degrades the photoreceptor coating layers, including the adhesive layer if it is included in the photoreceptor, and loosens the residual adhesive that attaches the flanges onto the substrate. In one embodiment, the stripping solution substantially or completely removes the residual flange adhesive. In embodiments, the stripping solution has minimum effect on a substrate surface, and does not harm any exposed portions of a substrate, because the stripping solution does not dissolve the components that make up the substrate. In one embodiment, the stripping solution may also have no impact on the dimensional characteristics of the substrate or the counterbore.

The stripping solution comprises an acid. Some examples of acids include, but are not limited to, nitric acid, hydrofluoric acid, hydrochloric acid, phosphoric acid, sulfuric acid, oxalic acid, acetic acid, carbonic acid, lactic acid, formic acid, malic acid, phthalic acid, and mixtures thereof. In one embodiment, the stripping solution comprises nitric acid. The concentration of the acid is generally within a range of from about 1% to about 90% by weight. In certain embodiments, the concentration of the acid is from about 10% to about 80% by weight, 30% to about 70% by weight, 45% to about 65% by weight, or about 65% by weight.

The stripping solution may comprises a co-solvent which may be present at a concentration ranging from about 1% to about 70% by weight of the stripping solution. Examples of co-solvent include, for example, water, methanol and ethanol, dimethylformamide, N-methylpyrrolidone, toluene, methyl ethyl ketone, acetone, ethyl acetate, xylene, and the mixtures.

In some cases, toxic acidic gases, nitrogen oxides (NOx) which contain nitric oxide (NO) and nitrogen dioxide ($NO_2$) may be formed during the process of contacting an electrophotographic photoreceptor with a stripping solution.

A small amount of ammonium sulfamate, imidazole derivatives, guanidine derivatives, amines and mixtures thereof may be added to the stripping solution to suppress the release of NOx without changing the effectiveness of the stripping process. The amount of ammonium sulfamate, imidazole derivatives, guanidine derivatives, amines and mixtures thereof present will generally be less than about 10% by weight. Typically, the amount will be less than 5% by weight, for example, 3%, 1%, 0.5%, 0.1% or 0% by weight. In one embodiment, ammonium sulfamate is added to the stripping solution. In some embodiments, the amount of ammonium sulfamate is less than about 10% by weight, or less than about 5% by weight.

An oxidizing agent may be added to the stripping solution to liberate bubbles of gas which functions to accelerate the degradation process of the coating layers and other adhesive materials in contact with the substrate. Specific examples of oxidizing agents include, for example, hydrogen peroxide, ammonium persulfate, potassium persulfate, sodium percarbonate, calcium percarbonate, sodium peroxide, barium peroxide, carbamide peroxide, acetyl peroxide, benzoyl peroxide, lauroyl peroxide, iron (III) nitrate, and mixtures thereof. In certain embodiments, the stripping solution comprises hydrogen peroxide. The content of the oxidizing agent is generally less than 20% by weight, more likely, less than 10% by weight. In one embodiment, the concentration of hydrogen peroxide ranges from about 0% to 10% by weight.

Other approaches for generating bubbles of gas in the stripping solution may also be applied in the invention. For example, bubbling air into the stripping solution is considered to have the same effect as the addition of an oxidizing agent into the stripping solution. Or, using an ozone generator attached to the stripping solution Alternatively, or in addition to generating bubbles of gas in the stripping solution, a vibratory energy, such as, an ultrasonic energy, may be applied to the stripping solution to accelerate the break down of the coating layers and the adhesive materials. In one embodiment, an ultrasonic bath, which provides heat and agitation to accelerate the break down of the coating layers and the adhesive materials, may be employed during the process of coating removal.

The methods of the invention may use a cathodic current that is applied to the substrate. The cathodic current generates hydrogen gas on the surface of the substrate that readily penetrates the coatings and the adhesive materials and reduces the metal oxide at the surface of the substrate, thereby causing the adhesion of the coatings to degrade more rapidly and accelerating the removal of the coatings and adhesive materials. In one embodiment, a cathodic current is applied to an aluminum substrate. In a further embodiment, a cathodic current is applied to an aluminum substrate and reduces the aluminum oxide at the surface of the aluminum substrate.

Typically, the cathodic current density is in a range of from 10 to 100 ampere per square foot and highly dependant on the stripping solution temperature and acid concentration.

The temperature of the stripping solution may be kept at or below room temperature. The temperature of the stripping solution may also be elevated to improve dissolution, or degradation, of the coating layers, and to reduce the cohesive strength of the adhesive materials that hold the flanges in contact with the substrate. In certain embodiments, the temperature of the stripping solution is maintained within a range of between 20° C. to 98° C. In a further embodiment, the temperature of the stripping solution is maintained within a range of between 35° C. to 85° C. Generally, the temperature of the stripping solution impacts the photoreceptor coatings removal process speed.

The length of time of subjecting an electrophotographic photoreceptor to a stripping solution required to allow the coatings and the adhesion strength of the adhesive materials to degrade varies, and it is dependent upon any one or any combinations of the aforementioned factors disclosed herein. The factors include, for example, the concentration of nitric acid, the concentration of ammonium sulfamate, the concentration of the oxidizing agent or the bubbling gas flow rate, the presence of an ultrasonic energy, the temperature of the stripping solution, the presence and the density of a cathodic current. Generally speaking, the higher the temperature of the stripping solution, the higher the acid concentration, the higher the oxidizing agent concentration, the presence of an ultrasonic energy, or the presence of a cathodic current, will result a shorter length of time for the coatings and the adhesion strength of the adhesive materials to degrade upon subjecting an electrophotographic photoreceptor to a stripping solution. Temperature is among the strongest factors that impact the length of the soaking time period. The length of time of subjecting an electrophotographic photoreceptor to a stripping solution is typically in a range from about 1 minute to about 10 hours. In one embodiment, the length of time of subjecting an electrophotographic photoreceptor to a stripping solution is from about 5 minutes to about 2 hours. In another embodiment, the length of time of subjecting an electrophotographic photoreceptor to a stripping solution is less than about 1 hour.

In accordance with one embodiment of the invention, an electrophotographic photoreceptor may be placed in a stripping solution and allowed to be soaked for a period of time, about 5 minutes to about 5 hours, during which period the plurality of coating layers and the adhesion strength of the adhesive materials attaching the flanges to the substrate will degrade. Following the stripping solution soak, the plurality of coating layers from the substrate may be separated by peeling the plurality of coating layers off or by scraping the plurality of coating layers away. If the flanges are present, the flanges can be separated from the substrate by peeling, scraping and removing actions can be performed by hand or using a tool such as a razor, doctor blade, skive, brushes, scrubbing pads. The flanges can be removed by applying torque & pull force to grippers or by impact using a bar or rod inserted in one end. The coating layers may be degraded partially or completely. Typically, the flanges are degraded partially and may not be re-usable after soaking in the stripping solution.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

The present invention will be described in further detail with reference to the following examples and comparative examples. All the "parts" and "%" used herein mean parts by weight and % by weight unless otherwise specified.

Several exemplary stripping solution conditions of the invention were studied in the following examples.

Example 1

An electrophotographic photoreceptor in drum format, rejected from production line because of coating defects, having aluminum substrate with undercoat layer, charge generation layer and charge transport layer, was soaked in a stripping solution containing 55% of nitric acid and 0% of hydrogen peroxide. The temperature of the stripping solution was maintained at 55° C. All coating layers are degraded and are removed off from the aluminum substrate after less than 1 hour of soaking time. After washing and drying, the cleaned drum has no detectable dimension change.

Example 2

A Xerox photoreceptor drum (30 mm diameter×355 mm) was soaked in 455 g of concentrated nitric acid (i.e. 70% of nitric acid) for one hour. The temperature of the nitric acid was kept at between 60° C. to 70° C. The undercoat layer, charge generation layer, and charge transport layer including the protective overcoat layers are degraded and are removed from the aluminum substrate after 35 minutes of soaking time. After washing and drying, the substrate showed no dimension change.

Example 3

An electrophotographic photoreceptor drum with flanges, taken out of a Xerox copier because the end of photoreceptor application life, was soaked in a stripping solution containing 65% of nitric acid and 1% of ammonium sulfamate. The temperature of the stripping solution was maintained at 80° C. The undercoat layer, charge generation layer, and charge transport layer and the overcoat layer were degraded and were removed from the aluminum substrate after 1 hour of soaking time. The flanges were also removed off easily by hand. After washing and drying, the substrate showed no measureable dimension change All the patents and applications referred to herein are hereby specifically, and totally incorporated herein by reference in their entirety in the instant specification.

It will be appreciated that various of the above-disclosed and other features and functions, or alternatives thereof, may be desirably combined into many other different applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method of separating a plurality of coating layers from a substrate of an electrophotographic photoreceptor, wherein the plurality of coating layers are disposed over the substrate, the method comprising the steps of:

subjecting the electrophotographic photoreceptor to a stripping solution, wherein the stripping solution comprises nitric acid and further comprises ammonium sulfamate; and separating the plurality of coating layers from the substrate of the electrophotographic photoreceptor.

2. The method of claim 1, wherein the electrophotographic photoreceptor further comprises a flange adhesively fixed to at least one end of the substrate and the method further includes separating the flange from the substrate.

3. The method of claim 1, wherein the subjecting step comprises soaking the electrophotographic photoreceptor in the stripping solution.

4. The method of claim 1, wherein the nitric acid has a concentration of from about 5% by weight to about 90% by weight.

5. The method of claim 1, wherein the ammonium sulfamate has a concentration of less than 5% by weight.

6. The method of claim 1, wherein the stripping solution further comprises an oxidizing agent.

7. The method of claim 1, including applying a cathodic current to the substrate during the subjecting step.

8. The method of claim 1, wherein the electrophotographic photoreceptor is soaked in the stripping solution for a period of between about 1 minute and about 10 hours.

9. The method of claim 1, including maintaining the stripping solution at a temperature in a range of 20° C. to 98° C.

10. The method of claim 1, wherein the substrate has a thickness of from about 0.25 mm to about 5 mm.

11. The method of claim 1, wherein the substrate is made from aluminum, or an aluminum alloy.

12. The method of claim 1, wherein the plurality of coating layers comprises one or more of the following layers: an undercoat layer, a charge generation layer, a charge transport layer, and an overcoat layer.

13. The method of claim 6, wherein the oxidizing agent has a concentration of less than 20% by weight.

14. The method of claim 6, wherein the oxidizing agent is hydrogen peroxide.

15. The method of claim 7, wherein the cathodic current is of a density between 10 to 100 ampere per square.

16. The method of claim 12, wherein the plurality of coating layers further comprises an adhesive layer disposed over the substrate.

17. A method of separating a plurality of coating layers from a substrate of an electrophotographic photoreceptor, wherein the plurality of coating layers are disposed over the substrate, the method comprising:

soaking the electrophotographic photoreceptor in a stripping solution, wherein the stripping solution comprises nitric acid, hydrofluoric acid, hydrochloric acid, phosphoric acid, sulfuric acid, oxalic acid, acetic acid, carbonic acid, lactic acid, formic acid, malic acid, phthalic acid, or mixtures thereof, wherein the stripping solution further comprises ammonium sulfamate;

degrading the plurality of coating layers with the stripping solution; and separating the plurality of coating layers from the substrate of the electrophotographic photoreceptor.

18. The method of claim 17, wherein the separating the plurality of coating layers from the substrate occurs without degrading or attacking any portion of the substrate.

* * * * *